US007794364B2

(12) United States Patent
Killgore et al.

(10) Patent No.: US 7,794,364 B2
(45) Date of Patent: Sep. 14, 2010

(54) SHOE FOR DEEP-WATER-RUNNING EXERCISE

(75) Inventors: Garry L. Killgore, McMinnville, OR (US); Jeffrey A. Thomas, McMinnville, OR (US); Jonathan Andrews, McMinnville, OR (US); David L. Burton, McMinnville, OR (US); Stephen V. Cooper, Amity, OR (US); John Kent, McMinnville, OR (US)

(73) Assignee: AQX, Inc., McMinnville, OR (US)

( * ) Notice: Subject to any disclaimer, the term of this patent is extended or adjusted under 35 U.S.C. 154(b) by 0 days.

(21) Appl. No.: 10/545,788

(22) PCT Filed: Dec. 29, 2004

(86) PCT No.: PCT/US2004/043954

§ 371 (c)(1),
(2), (4) Date: Aug. 17, 2005

(87) PCT Pub. No.: WO2005/065784

PCT Pub. Date: Jul. 21, 2005

(65) Prior Publication Data

US 2006/0229168 A1 Oct. 12, 2006

Related U.S. Application Data

(60) Provisional application No. 60/533,049, filed on Dec. 30, 2003.

(51) Int. Cl.
*A63B 31/00* (2006.01)

(52) U.S. Cl. ..... 482/55; 482/111; 441/61

(58) Field of Classification Search ..... 482/55, 482/111; 434/254, 255; 441/55, 56, 59–64, 441/136; 36/3 R, 3 A, 3 B, 81, 113, 114, 36/116, 132, 133, 136, 139; D2/896, 902, D2/903, 909, 946, 969, 976, 977; D21/685, D21/672, 678, 766, 760, 801, 804, 806
See application file for complete search history.

(56) References Cited

U.S. PATENT DOCUMENTS

| | | | | | |
|---|---|---|---|---|---|
| 1,480,366 | A | * | 1/1924 | Bergerson | 441/60 |
| D201,325 | S | * | 6/1965 | Hatao | D21/804 |
| 3,783,532 | A | | 1/1974 | Harradine | |
| 4,411,422 | A | | 10/1983 | Solloway | |
| 4,521,011 | A | * | 6/1985 | Solloway | 482/111 |
| 4,813,668 | A | | 3/1989 | Solloway | |
| D302,197 | S | * | 7/1989 | Greeley | D2/903 |
| 5,031,904 | A | | 7/1991 | Solloway | |

(Continued)

FOREIGN PATENT DOCUMENTS

CA 961 063 A 1/1975

*Primary Examiner*—Loan Thanh
*Assistant Examiner*—Tam Nguyen
(74) *Attorney, Agent, or Firm*—Clark & Brody

(57) ABSTRACT

An apparatus for use in exercising in water, preferably deep water running, includes a shoe that is configured to be worn by the user. The shoe includes a plurality of drag-generating elements attached to and extending from each side of said shoe for generating drag forces on the shoe during movement in water. The drag-generating elements generate more drag for movement of said shoe in a rearward direction than in a forward direction and are sized and positioned to simulate the forces on the user's foot arising from land-based running.

16 Claims, 4 Drawing Sheets

U.S. PATENT DOCUMENTS

D320,688 S * 10/1991 McKinstry ..... D2/969
5,087,217 A * 2/1992 Tuan et al. ..... 441/61
5,096,189 A 3/1992 Beasley
5,102,120 A 4/1992 Lindblad
D332,691 S * 1/1993 Shin ..... D2/972
5,338,275 A * 8/1994 Chek ..... 482/111
5,490,823 A * 2/1996 Awbrey et al. ..... 482/55
5,795,204 A 8/1998 Bruner
5,820,530 A * 10/1998 Kallassy ..... 482/111
6,109,990 A 8/2000 Lundberg
D450,917 S * 11/2001 Fogg ..... D2/972
6,871,420 B2 4/2004 Shikhashvili
6,769,202 B1 * 8/2004 Luthi et al. ..... 36/28
2004/0055183 A1 * 3/2004 Lee et al. ..... 36/128

* cited by examiner

SHOE FOR DEEP-WATER-RUNNING EXERCISE

This application is the national stage of International Application Number PCT/US2004/043954, filed Dec. 29, 2004, which was published in English, and claims priority of U.S. Provisional Application No. 60/533,049 filed Dec. 30, 2003.

TECHNICAL FIELD

This invention relates to an apparatus for wearing on a user's foot during the exercise known as deep water running (DWR) to simulate running on land.

BACKGROUND ART

Approximately 30 million Americans participate in running as a form of general exercise for fitness and health. It has also been estimated that up to 70% of this population will incur a running-related injury. Running has been described as "essentially a series of collisions with the ground," and these collisions typically exhibit vertical ground reaction forces (VGRF) of 1.5 to 3 times the runner's body weight. These impact forces, as well as training errors resulting from increasing the total volume of mileage too rapidly and/or excessive mileage, are at least partially responsible for the creation of many running-related injuries.

A known method of decreasing the running impact forces and the negative effects of excessive mileage is to supplement a runner's training program with deep-water running (DWR) in a pool. This mode of training allows the runner to mimic the terrestrial running style in the pool while typically using a buoyancy device, e.g., AquaJogger®, to support the runner's weight. It has been reported that the DWR training method decreases spinal and joint compressive loading, which decreases the likelihood of incurring running-related injuries. A rationale for deep-water running (DWR) is that it allows the runner to train with movements similar to that found on land without incurring the impact forces, which greatly reduces the repetitive loading of the musculoskeletal system. Rehabilitation after injury, rather than prevention, is the most common use of deep water running.

Despite the increasing use of DWR for rehabilitation and more recently as training to supplement a normal regimen, very little research focuses on the DWR technique. Several sources describe "proper" DWR techniques, but it appears that the most common DWR style is characterized by a high-knee or piston-like leg action. In contrast, the cross-country style is intended to be more like land-based running. The specificity-of-training principle suggests that the movement pattern of DWR should be closely aligned with that of terrestrial running to maximize the benefit to the runner. The cross-country style of DWR is the one most like terrestrial running, particularly in terms of the horizontal ankle displacement.

SUMMARY OF THE INVENTION

In accordance with the invention, a shoe is particularly designed for use in DWR exercise to enhance the effects of the accommodating resistance provided by the water when the foot is moving from the anterior (front) to the posterior (back) portion of the gait. The unique construction of the shoe in accordance with the invention allows the runner to maintain proper running technique throughout the normal range of motion and to benefit from enhanced resistance in the appropriate planes of motion and minimal drag when appropriate.

As used herein, "shoe" means any article that is attached to a user's foot and includes that commonly known as a sandal, or a sock, or other similar articles.

The shoe according to the invention utilizes the accommodating resistance properties of water by increasing or decreasing drag to maximize resistance in the appropriate planes of motion inherent in a running gait. Increased overall benefit to the runner and an improved "feel" of the DWR exercise are achieved. Applicants' research also suggests that wearing a shoe during DWR enhances kinesthetic perception and further helps the runner achieve a gait during DWR that is more similar to that of land-based running.

In the preferred embodiment, enhanced resistance is achieved by attaching three small scoops to each side of the shoe at the forefoot, mid-foot, and heel areas of the shoe. The scoops create fluid drag, and the size, configuration, and placement of the scoops are important to the effective operation of the shoe in DWR.

The scoops must be configured and placed such that they conform both to the characteristics of the shoe and to the user's foot. For example, the scoops are generally placed on the sides of the shoe, and the front part of the side of a shoe generally tapers downward such that the sides are shorter in that part of the shoe. Accordingly, the height of the scoop in the forward part of the shoe is often limited. In addition, applicants have found that the characteristics of the user's foot affect the size and placement of the scoops and the materials from which the scoops may made. In particular, the foot articulates at the ankle and the ball, which means that rigid scoops that will restrict that motion must be avoided.

Applicants have further discovered that the size and placement of the scoops affects the stability of the shoe during the running motion. Instability of the shoe, in turn, is transmitted to the runner and has a significant impact on its feel and its ability to simulate running on land. In addition, instability of the shoe results in transmission of forces to the runner, which could affect the runner's hip, knee, and ankle joints.

In accordance with the invention, a DWR shoe has more than one scoop attached to each side of the shoe such that they are generally symmetrical with respect to a vertical plane passing through the longitudinal axis of the shoe. One objective in placing the scoops in a symmetrical fashion is to ensure that the forces arising from fluid drag on both sides of the shoe are approximately equal. This approach generally is more effective in simulating land running. While the main purpose of the invention is the simulation of land or treadmill running, it is within the contemplation of the invention to arrange the scoops in an asymmetrical fashion, for example, for rehabilitation.

Applicants have found that placing a single scoop, or fin, on the shoe or a single scoop on each respective side of the shoe generates flutter in the shoe as it moves through the water. This flutter is substantially eliminated by the use of more than one scoop longitudinally arranged on the side of the shoe. Further, a shoe with a single scoop could lead to hyperextension of the runner's knee.

The use of several scoops spaced along the side of the shoe distributes the drag forces along the foot longitudinally, which reduces flutter in the yaw direction (i.e., about a vertical axis). One reason for this may be that the angle of the foot changes during the running motion, with the foot pointing more upward (dorsiflexed) during the forward part of the motion. It must also be remembered that the scoops create torque on the shoe, and very large scoops are therefore not generally desired for that reason.

The fins may be configured to create different amounts of drag, and applicants have found it generally advantageous for the scoop located nearest the back of the shoe to create the largest amount of drag. The use of the largest scoop at the rear of the shoe is advantageous because the rear part of the shoe is better able to accommodate a large scoop and also because that places the most drag at the runner's heel, which further assists in simulating the feel of land-based running.

The shape and size of a scoop are primary factors affecting the drag it produces during the forward and aft movements. Because the foot does not move strictly linearly (see FIG. 1) the shape affects the drag applied to the shoe in a variety of directions. It will also be appreciated that the movement of a runner's foot is rather complex because in normal running the foot rotates as the toes come up during the forward motion and then rotates down during the rearward motion. In the preferred embodiment the scoops are generally conical with the front surfaces of the scoops sloping toward the side of the shoe from the back to the front. This configuration reduces drag in the forward direction while providing desired drag in the aft direction.

Preferably the scoops in the front of the shoe are smaller than those at the rear. This assists in reducing flutter it is believed by reducing the effects of twisting (torsion) forces on the front of the foot by scoops that are too wide.

Configuring the scoops with tapered front surfaces also allows the water to flow around the rear scoop and engage the scoop in front of it with less turbulence. Further, this reduces the shadowing of a forward scoop by a rearward one. Thus, the majority of the drag is provided by the rearmost scoop, and the drag provided by the foremost scoop is the least.

In the preferred embodiment, the scoops are located on the shoe in a lower position of the sidewall. This places the drag forces lower on the shoe to further assist in simulating the application of forces that arise during land running.

An object of this invention is to provide a shoe that simulates land-based running.

Another object of this invention is to provide a shoe for use in DWR exercising.

A further object of this invention is to provide a shoe having several elements that create fluid arranged on a shoe for creating drag simulating land-based running.

DETAILED DESCRIPTION OF THE PREFERRED EMBODIMENTS

Figure 1:
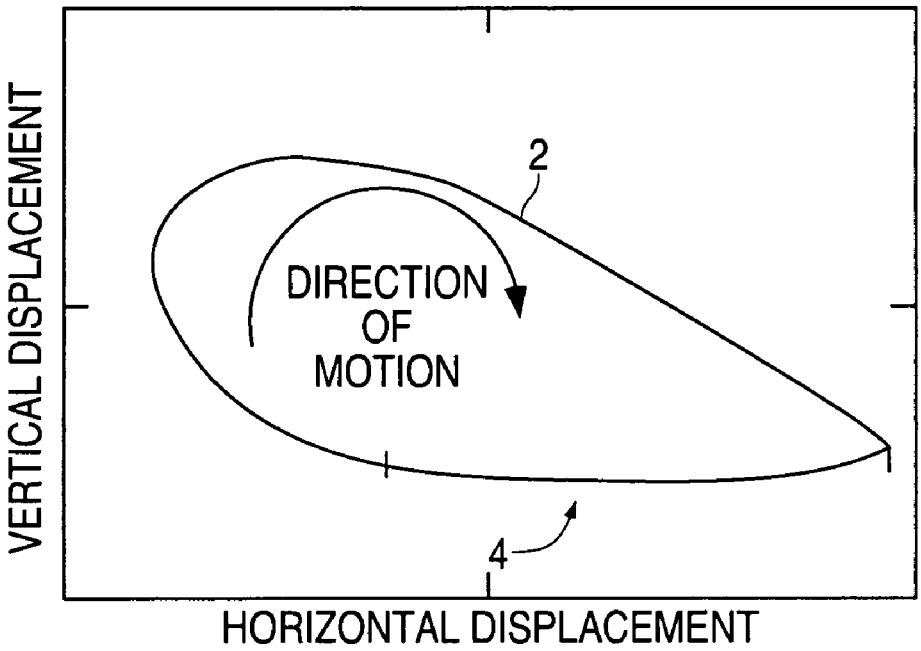
FIG. 1 is a plot showing the typical motion of a foot during dry-land running on a treadmill.

The present invention is a shoe, as defined above, for use in deep water running (DWR). FIG. 1 illustrates the motion of the ankle of a runner when running on a treadmill. The curve 2 illustrates motion in a vertical plane when the runner is viewed from the right side, and the treadmill is moving from right to left. It will be appreciated that the bottom, somewhat linear portion, 4 of the graph represents movement of the foot when in contact with the treadmill.

Figure 2:
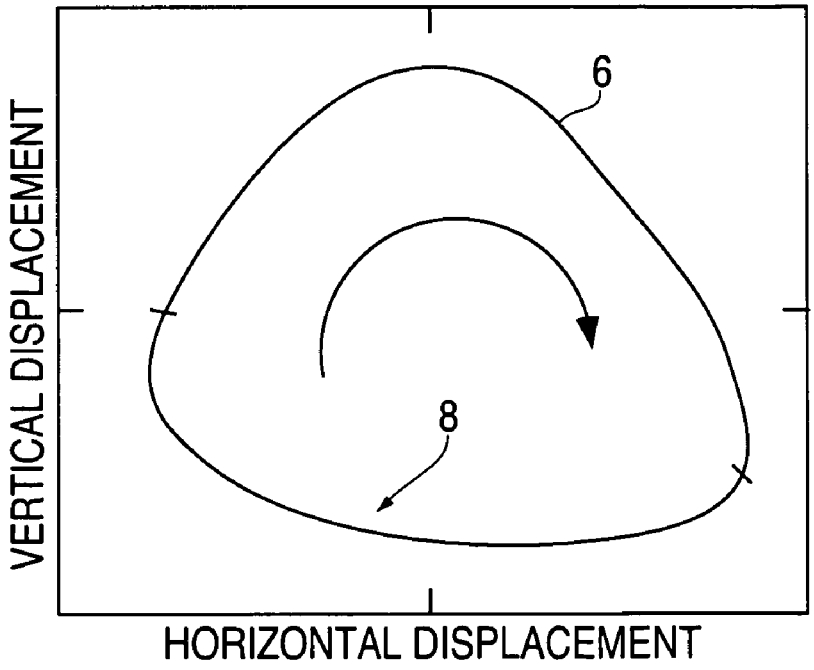
FIG. 2 is a plot showing typical motion of a foot during deep water running with the article of the invention.

FIG. 2 illustrates motion of the ankle of a runner wearing a shoe according to the invention. It will be appreciated that the curve 6 approximates the motion shown in FIG. 1. The portion 8 of the graph 6 represents that part of the motion of the foot during which increased resistance is provided by the shoe of the invention.

When worn by the user while running in deep water to simulate land-based running, the shoe provides low-impact water exercise. The foundation of the shoe preferably resembles a standard running shoe. The materials are selected for use in water, such as materials that are less susceptible to chemical attack from chlorine. The shoe may have a fabric upper and an elastomeric sole and may also be provided with one or more openings or the like to allow water to drain out of the shoe after use. Attached to the foundation along each side of the shoe are scoop-shaped protrusions. These protrusions are shaped to minimize hydrodynamic drag on the foot as it moves forward through the water. This shape also maximizes the drag as the runner moves his foot back though the water. Optimally the drag when moving in the backwards direction is 25%-30% greater than when moving in the forward direction.

The scoop shape, size, material and position on the foundation are important to the performance of the device. The preferred embodiment of the invention uses three scoops per side, lined up in a row from the toe of the foundation to the heel. The scoop located nearest the heel is the largest of the three. The center scoop, located near the arch, is somewhat smaller. The scoop nearest the toe is the smallest. The scoop material is a semi-rigid plastic, which can be formed to the desired shape and affixed to the side of the foundation.

Figure 3:
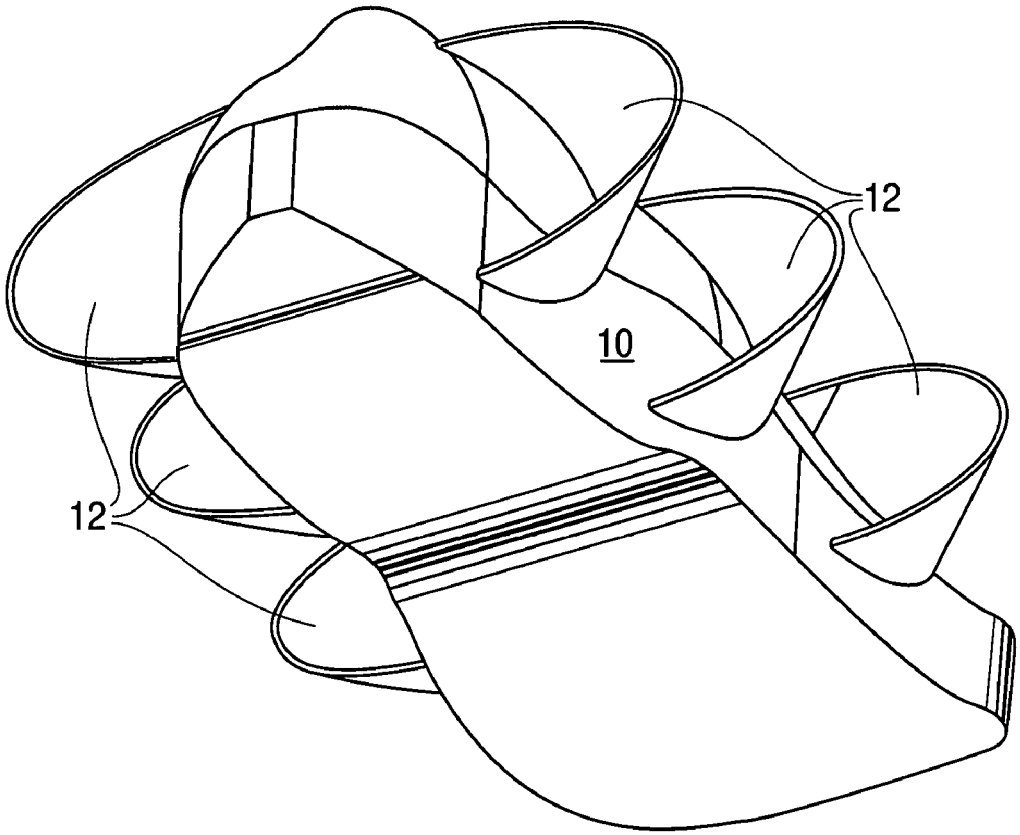
FIG. 3 is a bottom perspective view of a DWR shoe according to the invention.
Figure 4:
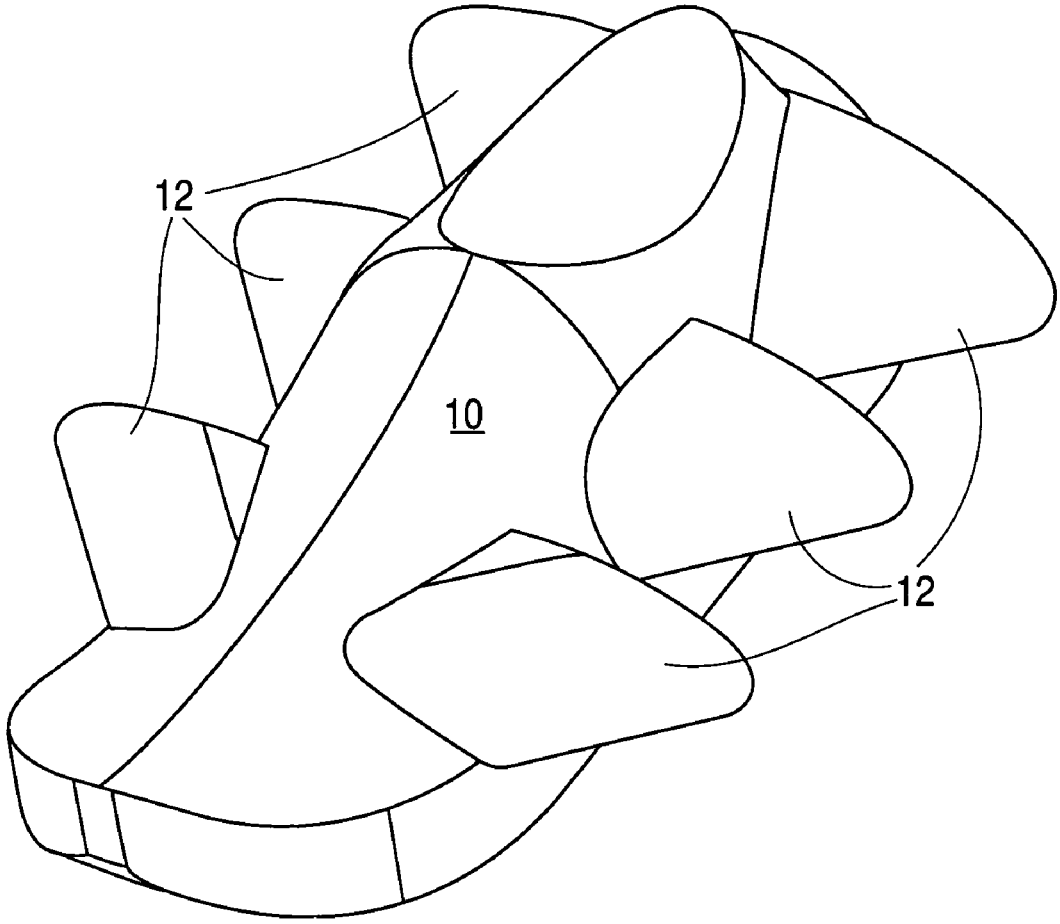
FIG. 4 is a top perspective view of the shoe shown in FIG. 3.

FIGS. 3 and 4 are perspective views of a shoe 2 according to the invention. A shoe foundation 10 may be formed in any of several shapes, a typical running shoe being illustrated. As noted above, however, the foundation may be in the form of a sock, a sandal, a boot, or the like. Preferably, however, the foundation is relatively small and light to provide the feel of a running shoe to simulate land running. The shoe according to the invention includes a plurality of scoops 12 attached to the sides of the shoe for the purpose of providing drag during the rearward movement of the shoe.

Figure 4A:
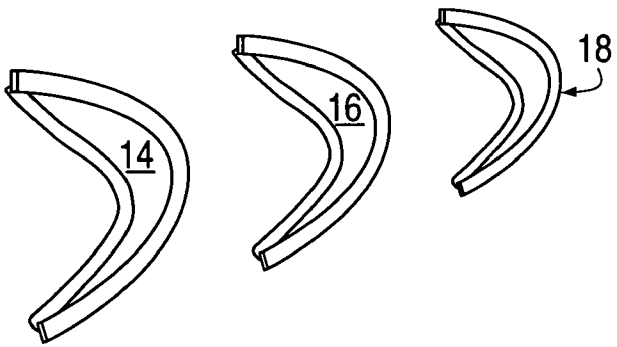
FIGS. 4*a*, 4*b*, and 4*c* illustrate preferred configurations and arrangements of the scoops.
Figure 4B:
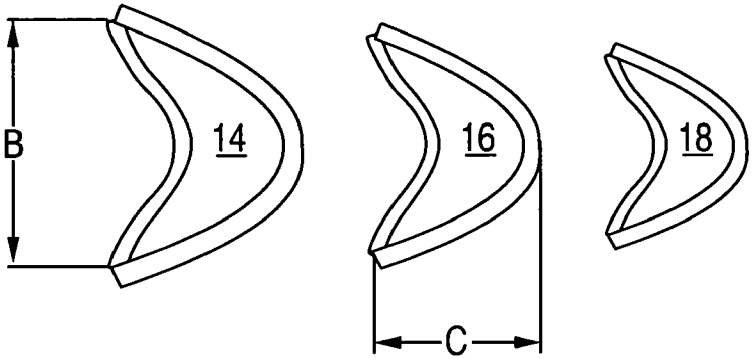
Figure 4C:
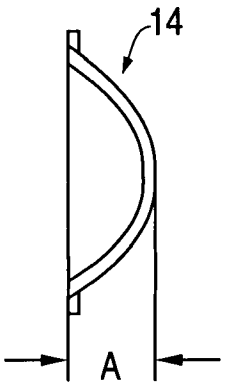

FIGS. 4*a*, 4*b*, and 4*c* illustrate preferred scoops for use with a shoe of the invention. FIG. 4*a* is a perspective view of three scoops 14, 16, and 18, which are preferably arranged in a line as shown on a shoe. Scoop 14 would be placed at the rear of the shoe and is the largest of the three scoops. Scoop 14 is preferably placed at the rear of the shoe and may be placed at the heel so that the rearmost part of the scoop 14 is flush with the rear of the shoe. This configuration allows the scoop to engage the water without the effects of turbulence created by the water flowing around the shoe before engaging the scoop. Thus, this scoop can be configured to provide the largest degree of drag. Scoop 16 is smaller that scoop 14 and scoop 18 is smaller than scoop 16.

It will be appreciated that in the preferred embodiment, the scoops are attached to the sides of the shoe. This applies the drag forces to the side of the user's foot near the bottom of the shoe to simulate the forces applied by contact with the ground in land-based running. Thus, the scoops are preferably placed on the side of the shoe well below the ankle, and in some instances my actually extend onto the bottom (sole) of the shoe.

FIG. 4*b* is a side view of the scoops shown in FIG. 4*a* and FIG. 4*c* is an end view. These figures show some of the relevant dimensions of the scoops. Dimension "A" of FIG. 4*c* is the depth of a scoop, "B" is the height of a scoop, and "C" is the length of a scoop and "D" is the spacing between adjacent scoops.

In the preferred embodiment, a shoe has 2 to 4 scoops arranged longitudinally on each side of a shoe, and preferably has three such scoops on each side. It is within the contemplation of the invention to provide a different number of scoops on each respective side, but in the preferred embodiment the scoops are symmetrical about a vertical plane. The depth of the scoops ("A") may be in the range of from about 6 mm to about 40 mm and more preferably in the range of from about 9 mm to about 22 mm. The height of the scoops ("B") may be in the range of from about 19 mm to about 75 mm and more preferably from about 25 mm to about 63 mm. The lengths of the scoops ("C") may be in the range of from about 12 mm to about 50 mm and more preferably from about 18 mm to about 45 mm. The spacing of the scoops may be in the range of from about 50 mm to about 75 mm and preferably about 57 mm.

In a preferred embodiment, five scoops of generally arcuate cross section, tapered configuration are configured as set forth in the following table, and the three largest scoops are used for larger shoes (e.g., sizes 13, 14), the three smallest scoops are used for smaller shoes, and intermediate scoops are used with shoes of intermediate size. The difference in drag between a scoop and the adjacent scoop may be in the range of 10% to 20%.

TABLE A

| | SCOOP | | | | |
|---|---|---|---|---|---|
| | 1 | 2 | 3 | 4 | 5 |
| "A" | 22.1 mm | 18.1 mm | 14.6 mm | 11.5 mm | 8.9 mm |
| "B" | 62.7 mm | 51.5 mm | 41.3 mm | 32.9 mm | 25.2 mm |
| "C" | 44.4 mm | 36.4 mm | 29.2 mm | 23.3 mm | 17.9 mm |

Applicant's have found that a typical running shoe without scoops provides about eleven percent more drag during rearward motion than in forward motion, when the average velocity of the foot is about 3.6 ft./sec. In the preferred embodiment with the scoops of Table A attached to the sides of the shoe, the scoops produce 12% to 33% more drag in the rearward direction when the average velocity of about 3.6 ft./sec. In the preferred embodiment, the scoops provide about 28% percent increased drag during rearward movement.

It will be appreciated that while the preferred embodiment utilizes scoops to provide the desired degree of increased drag as described above, other elements may be provided with similar effect. It is not necessary to use a hollow "scoop" as such, and it may be possible to use other drag-creating elements, such as a flat or slightly curved paddle, or the like, that extends outward from the sides of the shoe. The front of such an element may include a fairing or similar structure to reduce the drag during forward motion of the foot. An advantage of a scoop is that it is conveniently attached to the shoe by stitching and may be conformed to the shape of other structures on the shoe whereby the same stitching is used for the scoop as well as for the other structures.

Modifications within the scope of the appended claims will be apparent to those of skill in the art.

We claim:

1. Apparatus for use in exercising in water comprising a shoe foundation configured to be attached to the foot of a user, said shoe foundation being configured to extend along said foot when worn by said user and comprising forefoot, mid-foot, and heel areas and a plurality of drag-generating elements attached to each side of said shoe foundation and spaced along said shoe foundation in a direction extending from the forefoot area to the heel area, below the user's ankle and above the sole of said foot, when said shoe foundation is worn by said user, for generating drag forces in said direction in water on said foot during use, wherein said drag-generating elements generate larger drag forces in water when said shoe foundation is moved rearward in said direction at a given velocity than when moved forward in said direction at said velocity and generate substantially equal drag forces on both sides of said shoe foundation, wherein a respective rearmost one of said drag-generating elements is located at the rear area of each side of said shoe foundation, and said rearmost one of said drag-generating elements is larger than the other drag-generating elements on the same side of said shoe foundation.

2. Apparatus according to claim 1 wherein said drag-generating elements provide increased drag for rearward motion in water compared with forward motion of at least 12% when said velocity averages about 3.6 feet/second.

3. Apparatus according to claim 1 wherein there are three of said drag-generating elements on each side of said shoe foundation.

4. Apparatus according to claim 1 comprising three drag-generating elements on each respective side of said shoe foundation.

5. Apparatus according to claim 4 wherein a foremost drag-generating element on each respective side of said shoe foundation is smaller than the other drag-generating elements on the same side of said shoe foundation.

6. Apparatus for use in exercising in water comprising a shoe foundation configured to be attached to the foot of a user, said shoe foundation being configured to extend along said foot when worn by said user and comprising forefoot, mid-foot, and heel areas and a plurality of drag-generating elements attached to each side of said shoe foundation and spaced along said shoe foundation in a direction extending from the forefoot area to the heel area, below the user's ankle and above the sole of said foot, when said shoe foundation is worn by said user, for generating drag forces in said direction in water on said foot during use, wherein said drag-generating elements generate larger drag forces in water when said shoe foundation is moved rearward in said direction at a given velocity than when moved forward in said direction at said velocity and generate substantially equal drag forces on both sides of said shoe foundation, wherein each of said drag-generating elements comprises a scoop having an open end and a tapered front surface.

7. Apparatus according to claim 6 wherein the depth of said scoop is from about 6 mm to about 40 mm, the height of said scoop is from about 19 mm to about 75 mm, and the length of said scoop is from about 12 to about 50 mm.

8. Apparatus according to claim 7 wherein the depth of said scoop is from about 9 mm to about 22 mm, the height of said scoop is from about 25 mm to about 63 mm, and the length of said scoop is from about 18 mm to about 45 mm.

9. A method of exercise comprising attaching a shoe foundation to the foot of a user such that said shoe foundation extends along said foot and wherein said shoe foundation comprises forefoot, mid-foot, and heel areas and a plurality of drag-generating elements attached to each side of said shoe foundation and spaced along said shoe foundation in a direction extending from the forefoot area to the heel area, below the user's ankle and above the sole of said foot, said drag-generating elements generating drag forces on said foot in said direction when moved in water during use, said drag-generating elements generating larger drag forces in water when said shoe foundation is moved rearward in said direction at a given velocity than when moved forward in said direction at said velocity and generating substantially equal drag forces on both sides of said shoe foundation, and moving said foot and shoe foundation forward and rearward in said direction in water.

10. A method of exercise according to claim 9 wherein said movement of said foot comprises performing deep water running wherein said user simulates land based running while said foot is in water during movement in both said forward and rearward directions.

11. Apparatus according to claim 6 wherein said drag-generating elements provide increased drag for rearward motion in water compared with forward motion of at least 12% when said velocity averages about 3.6 feet/second.

12. Apparatus according to claim 6 wherein there are three of said drag-generating elements on each side of said shoe foundation.

13. Apparatus according to claim 6 wherein a respective rearmost one of said drag-generating elements is located at the rear area of each side of said shoe foundation.

14. Apparatus according to claim 13 wherein said rearmost one of said drag-generating elements is larger than the other drag-generating elements on the same side of said shoe foundation.

15. Apparatus according to claim 14 comprising three drag-generating elements on each respective side of said shoe foundation.

16. Apparatus according to claim 15 wherein a foremost drag-generating element on each respective side of said shoe foundation is smaller than the other drag-generating elements on the same side of said shoe foundation.

* * * * *